US007088257B2

(12) United States Patent
Weekes

(10) Patent No.: US 7,088,257 B2
(45) Date of Patent: Aug. 8, 2006

(54) SYSTEMS AND APPARATUS FOR SECURE SHIPPING

(76) Inventor: David Weekes, 4th Avenue #33 Mangrove Grove, Opposite Sugar Cane Club, Maynards, St. Peter 818 (BB)

( * ) Notice: Subject to any disclaimer, the term of this patent is extended or adjusted under 35 U.S.C. 154(b) by 0 days.

(21) Appl. No.: 10/986,864

(22) Filed: Nov. 15, 2004

(65) Prior Publication Data

US 2005/0275553 A1 Dec. 15, 2005

Related U.S. Application Data

(60) Provisional application No. 60/578,283, filed on Jun. 10, 2004, provisional application No. 60/590,436, filed on Jul. 23, 2004.

(51) Int. Cl.
*G08B 21/00* (2006.01)

(52) U.S. Cl. ..... 340/652; 340/568.6; 340/647; 324/541

(58) Field of Classification Search ..... 340/652
See application file for complete search history.

(56) References Cited

U.S. PATENT DOCUMENTS

| | | | | |
|---|---|---|---|---|
| 4,885,570 | A | 12/1989 | Chien | |
| 5,337,041 | A | 8/1994 | Friedman | |
| 5,646,592 | A | 7/1997 | Tuttle | |
| 5,656,996 | A * | 8/1997 | Houser | 340/541 |
| 6,160,478 | A | 12/2000 | Jacobsen et al. | |
| 6,198,394 | B1 | 3/2001 | Jacobsen et al. | |
| 6,400,268 | B1 * | 6/2002 | Lindskog | 340/550 |
| 6,611,783 | B1 | 8/2003 | Kelly et al. | |
| 6,898,299 | B1 * | 5/2005 | Brooks | 382/115 |
| 6,917,294 | B1 * | 7/2005 | Larsen | 340/573.2 |
| 2003/0011466 | A1 * | 1/2003 | Samuel et al. | 340/5.73 |
| 2004/0178913 | A1 | 9/2004 | Penuela et al. | |

FOREIGN PATENT DOCUMENTS

| | | |
|---|---|---|
| FR | 2434436 | 3/1980 |
| WO | WO 2004/037660 | 5/2004 |

OTHER PUBLICATIONS

PCT/IB2005/004010 Search Report dated May 12, 2006 (4 pages).

* cited by examiner

*Primary Examiner*—Daniel Wu
*Assistant Examiner*—George A. Bugg
(74) *Attorney, Agent, or Firm*—Finnegan, Henderson, Farabow, Garrett & Dunner, L.L.P.

(57) ABSTRACT

A container is provided. The container includes a casing having an opening for admitting contents into the container. A matrix of conductive lines extends across at least a portion of the casing. A sensor senses a breach of integrity of the matrix. An indicator indicates a breach of integrity of the container when the sensor senses a breach of integrity of the matrix. A system is also provided. The system includes a monitoring network and a container. The container includes a casing having an opening for admitting contents into the container. A matrix of conductive lines extends across at least a portion of the casing. A sensor senses a breach of integrity of the matrix. An interface transmits a signal to the monitoring network when the sensor senses a breach of integrity of the matrix, the signal indicating a breach of integrity of the container.

26 Claims, 3 Drawing Sheets

SYSTEMS AND APPARATUS FOR SECURE SHIPPING

RELATED APPLICATIONS

This application claims the benefit of priority under 35 U.S.C. 119 to U.S. Provisional Application No. 60/578,283, filed Jun. 10, 2004, and to U.S. Provisional Application No. 60/590,436, filed Jul. 23, 2004, which are expressly incorporated herein by reference in their entirety.

TECHNICAL FIELD

The present invention relates generally to the shipment of containers such as cargo containers, luggage, packages, envelopes, etc., and, more particularly, to systems and apparatus for the secure shipment of such containers.

BACKGROUND

With increased globalization comes the increased need to ship containers such as cargo, luggage, packages and envelopes, etc., efficiently around the globe. Shippers, such as airlines, freight lines, mail or delivery services, etc., have developed infrastructure to make such shipments efficiently. However, the need for increased security tends to increase the cost of shipping and cause delays in shipment.

For example, cargo containers are inspected at ports of entry and/or departure to ensure that they do not contain contraband; checked luggage is inspected and x-rayed to ensure that no weapons or explosives are brought on-board commercial airlines; and mail is inspected to ensure that prohibited items are not shipped through the mails. Each of these inspections increases the cost of shipping and adds to the time it takes to move containers from one place to another.

However, these inspections do not provide complete security because they do not prevent people from tampering with the container or its contents during shipping. First, items may be removed from the container during shipment. For example, the theft of items from checked luggage is a well-documented problem. Second, contraband may be added to the container after it has left the owner's hands. For instance, a package of illegal drugs or even an explosive device may be placed into checked luggage after it has been inspected. Third, an entire container may be lost or stolen during shipment. For example, a package or a piece of checked luggage may be accidentally or intentionally misdirected so that it does not arrive at its intended destination.

Existing systems fail to adequately prevent these problems from occurring. Consequently, existing systems fail to meet the security requirements of shippers, their customers, and the general public. Accordingly, there is a need for systems and apparatus to deter and prevent the loss or theft of shipped containers, or alteration of the contents of such containers during shipment.

SUMMARY

Systems and apparatus consistent with present invention address these and other needs by providing systems and apparatus to ensure that the integrity of shipped containers and to deter and prevent the loss or theft of such containers during shipment.

Consistent with the present invention, a container is provided. The container comprises a casing having an opening for admitting contents into the container. A matrix of conductive lines extends across at least a portion of the casing. A sensor senses a breach of integrity of the matrix. An indicator indicates a breach of integrity of the container when the sensor senses a breach of integrity of the matrix.

Consistent with the present invention, a system is provided. The system comprises a monitoring network and a container. The container comprises a casing having an opening for admitting contents into the container. A matrix of conductive lines extends across at least a portion of the casing. A sensor senses a breach of integrity of the matrix. An interface transmits a signal to the monitoring network when the sensor senses a breach of integrity of the matrix, the signal indicating a breach of integrity of the container.

It is to be understood that both the foregoing general description and the following detailed description are exemplary and explanatory only and are not restrictive of the invention, as claimed. Further features and/or variations may be provided in addition to those set forth herein. For example, the present invention may be directed to various combinations and subcombinations of the disclosed features and/or combinations and subcombinations of several further features disclosed below in the detailed description.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Figure 1A:
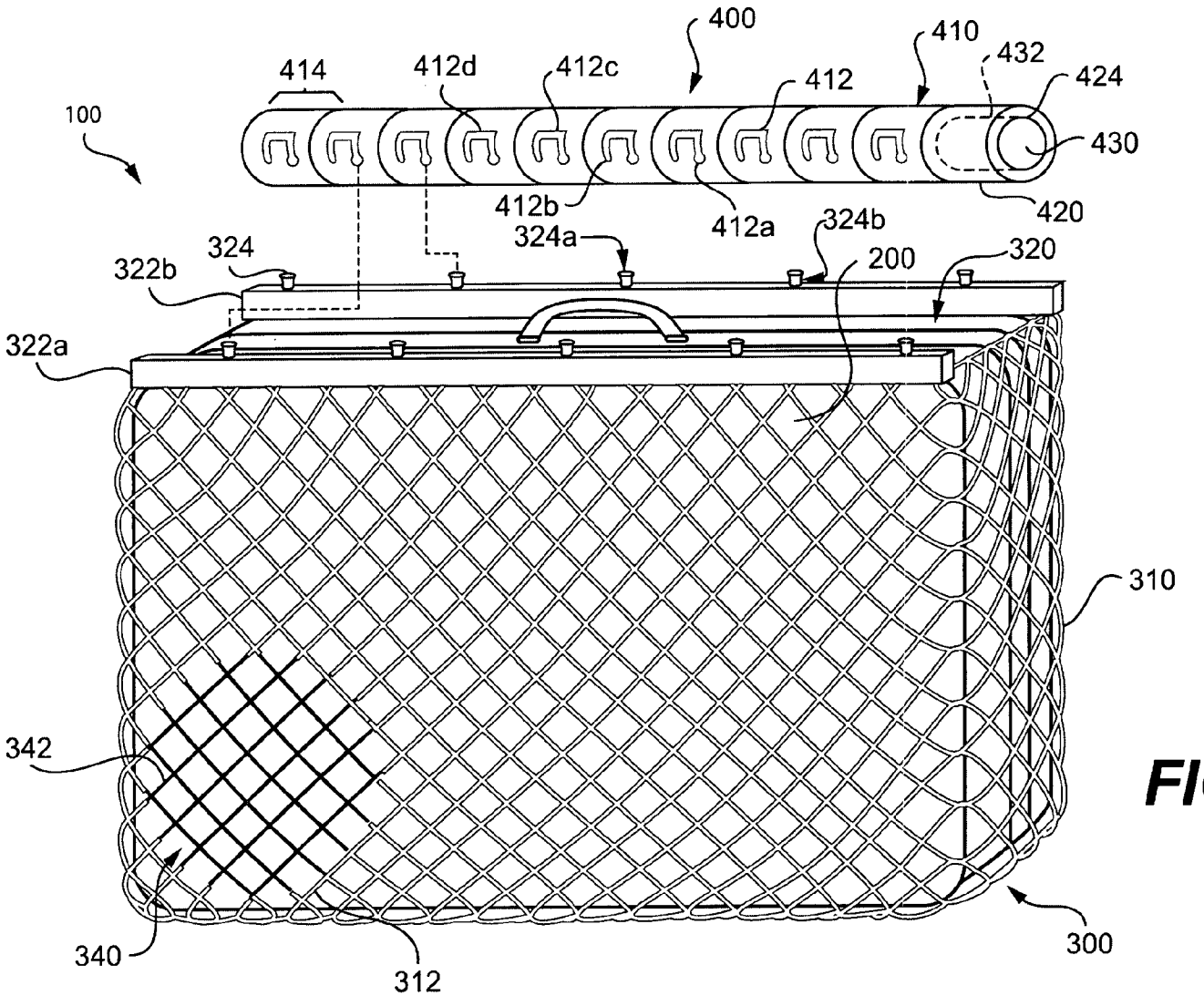
FIG. 1A shows a secure container, consistent with the present invention, in an open position.
Figure 1B:
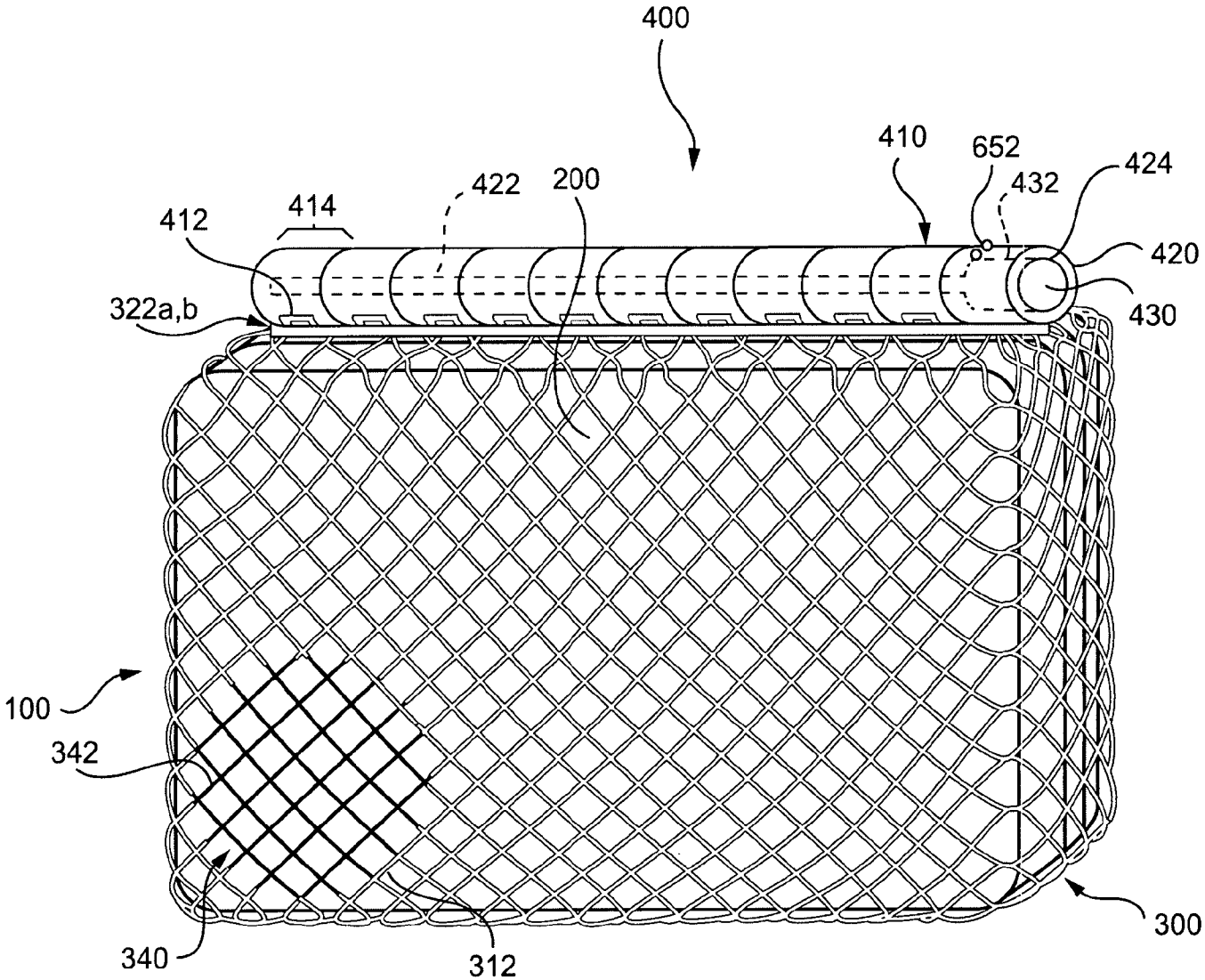
FIG. 1B shows secure container, consistent with the present invention, in a closed position.

FIGS. 1A and 1B show an exemplary secure container 100, consistent with the present invention. FIG. 1A shows secure container 100 in an open position; FIG. 1B shows secure container 100 in a closed position.

Secure container 100 may be configured to secure any desired contents 200. As illustrated in FIG. 1A, for example, secure container 100 may be configured to secure a conventional container, e.g., a conventional suitcase. However, secure container 100 may also be configured to resemble a conventional container. For example, secure container 100 may be configured as an envelope, a box, a suitcase, a cargo container, etc.

Secure container 100 may include a case 300 and a closure 400. Case 300 and closure 400 may be configured to physically deter and prevent tampering with the contents 200 of secure container 100 during shipment. Case 300 and closure 400 are each discussed in turn below with reference to FIGS. 1A and 1B.

Case 300 may include a casing 310 configured to encase desired contents 200 and an opening 320 for admitting contents 200 into the casing 310. Casing 310 may be of any desired size and shape and may be rigid or flexible, solid or porous, depending on the configuration of intended contents 200. As shown in FIGS. 1A and 1B casing 310 may, for instance, consist essentially of a mesh 312.

Mesh 312 may be formed from materials which present a physical barrier to tampering. Mesh 312 may be rigid or flexible. For example, mesh 312 may be formed from a flexible plastic material (e.g., polyvinyl, Teflon, PTFE, etc.) or flexible wire or cables (e.g., steel cabling). Alternatively, mesh 312 may be made by forming holes in a rigid material, e.g., a metal plate. Plastics may be chosen, e.g., where secure container 100 may be subject to x-ray screening, since such plastics may be transparent to x-rays.

The size of mesh 312 may be chosen to be fine enough so that no one may tamper with the intended contents 200 of secure container 100 without breaking or cutting mesh 312. For example, where secure container 100 is intended to secure a bulky item, such as a suitcase, the size of mesh 312 may be larger than where secure container 100 is intended to secure smaller items, such as loose cargo. The size of mesh 312 may also be chosen so as to allow inspection of contents 200 through mesh 312. For example, where secure container 100 is likely to be subjected to, e.g., x-ray inspection, the size of mesh 312 may be chosen to be large enough so as not to unduly obstruct the x-ray image of contents 200. Casing 310 may also be configured with solid and/or rigid sides. For example, casing 310 may include materials similar to those used in conventional containers, e.g., envelopes, boxes, luggage, cargo containers, etc. For instance, casing may be formed from paper, cardboard, woven material, solid plastic, metal, etc.

As illustrated in FIGS. 1A and 1B, casing 310 may be configured as one continuous structure. Alternatively, casing 310 may be configured as several pieces that may be connected together. For example, casing 310 may be configured as a box with a removable lid. Closure 400 may be provided to secure opening 320 in a closed position so as to prevent the loss or removal of the contents of secure container 100. Closure 400 may be implemented using any of a variety of container closures. For example, closure 400 may include a strap, clip, flap, detent, zipper, lid, etc.

In one embodiment consistent with the present invention, closure 400 may include a brace 410. As illustrated in FIG. 1A, brace 410 may be separable from casing 310. Alternatively, brace 410 may be affixed to casing 310, e.g., at one end of opening 320.

Brace 410 may be manufactured using a variety of materials which present a physical barrier to tampering. For example, brace 410 may be manufactured using case-hardened steel. To facilitate manipulation by the user, and to prevent snags during shipping, brace 410 may be formed with a smooth outer surface. For example, brace 410 may be formed as a circular cylinder, as shown in FIGS. 1A and 1B. However, brace 410 may be any of a variety of other shapes, without departing from the scope of the present invention.

Brace 410 may be configured to operably engage case 300 so as to secure opening 320 in a closed position. As shown in FIG. 1A, for example, case 300 may be provided with corresponding first and second cross-pieces 322*a* and 322*b*, respectively, surrounding opening 320. Cross-pieces 322*a* and 322*b* may each include a plurality of parallel knobs 324 alternately spaced along their lengths. Knobs 324 may each include a head portion 324*a* and a shaft portion 324*b*. Brace 410 may include a corresponding plurality of parallel tracks 412 configured to engage head portions 324*a* of knobs 324.

Each track 412 may include an open end 412*a* configured to allow knob 324 to be inserted into or removed from track 412, and a closed end 412*b* configured to prevent knob 324 from being removed from track 412. Each track 412 may further include first and second bends 412*c* and 412*d*, respectively, so that tracks 412 each form a "U" shape. However, tracks 412 may be configured in different shapes, e.g., with more or fewer bends, or no bends, consistent with the present invention.

To secure opening 320 in a closed position, a user may align cross-pieces 322*a* and 322*b* as shown in FIG. 1B and engage open ends 412*a* of respective tracks 412 with corresponding knobs 324 so that knobs 324 may enter respective tracks 412. The user may then rotate brace 410 so as to slide knobs 324 in parallel to first bends 412*c* of respective tracks 412, slide brace 410 so as to slide knobs 324 in parallel to second bends 412*d* of respective tracks 412, and, finally, rotate brace 410 in the opposite direction so as to slide knobs 324 in parallel to closed ends 412*b* of respective tracks 412.

For ease of manufacture, brace 410 may be formed of a plurality of substantially identical track units 414 connected together in series. Each track unit 414 may include one track 412. In this manner, brace 410 may be manufactured in different sizes by varying the number of track units 414 in brace 410.

Closure 400 may also include a locking mechanism 420. Locking mechanism 420 may be operative to lock opening 320 in the closed position. In one embodiment consistent with the present invention, locking mechanism 420 may be integrated with brace 410. For instance, locking mechanism 420 may be configured to lock opening 320 in the closed position by locking brace 410 in the closed position on case 300. For example, locking mechanism 420 may include a mechanical locking mechanism configured to lock brace 410 in the closed position when knobs 324 are moved to the closed ends 412*b* of tracks 412. For example, locking mechanism 420 may include a lock bar 422 (see FIG. 1B) within brace 410 that is configured to simultaneously engage knobs 324 so as to lock knobs 324 in place at the closed ends 412*b* of respective tracks 412. Lock bar 422 may be actuated mechanically, e.g., by the movement of knobs 324 to the closed ends 412*b* of tracks 412.

Locking mechanism 420 may be controlled, i.e., locked and unlocked, by a lock controller 424. Controller 424 may include any of a variety of lock control mechanisms. For example, lock controller 424 may be a mechanical key mechanism, a magnetic key mechanism, an electronic key mechanism, a password mechanism, a combination lock mechanism, etc. In one embodiment, lock controller 424 may include a biometric key mechanism. For example, lock controller 424 may be configured to lock or unlock locking mechanism 410 only upon scanning, e.g., a fingerprint, an iris, etc., of an authorized user. In this manner, lock controller 424 may prevent unauthorized users from tampering with the contents 200 of secure container.

For instance, lock controller 424 may include a scanner 430 operative to scan a user's fingerprint. Scanner 430 may be located on brace 410, e.g., at one end of brace 410 (as shown in FIG. 1C). Scanner 430 may include an appropriate scanner controller 432, e.g., electronics and/or software, configured to operate scanner 430. Scanner controller 432 may be located inside brace 410 in order to prevent unauthorized access. Lock controller 424 may also include a mechanism, e.g., a servomechanism configured to release locking mechanism 420 if scanner controller 432 indicates that a scanned fingerprint matches an authorized fingerprint. For example, lock controller 424 may include a servomechanism (not shown) for moving lock bar 422 from a locked to an unlocked position.

It is to be understood that closure 400 is not limited to the embodiment shown in FIGS. 1A and 1B. For example, brace 410 may be omitted and a closure resembling a conventional closure and/or locking mechanism 420 be provided on case 300. For instance, closure 400 and locking mechanism 420 may be implemented using a combination lock, e.g., as on a conventional briefcase.

Figure 2:
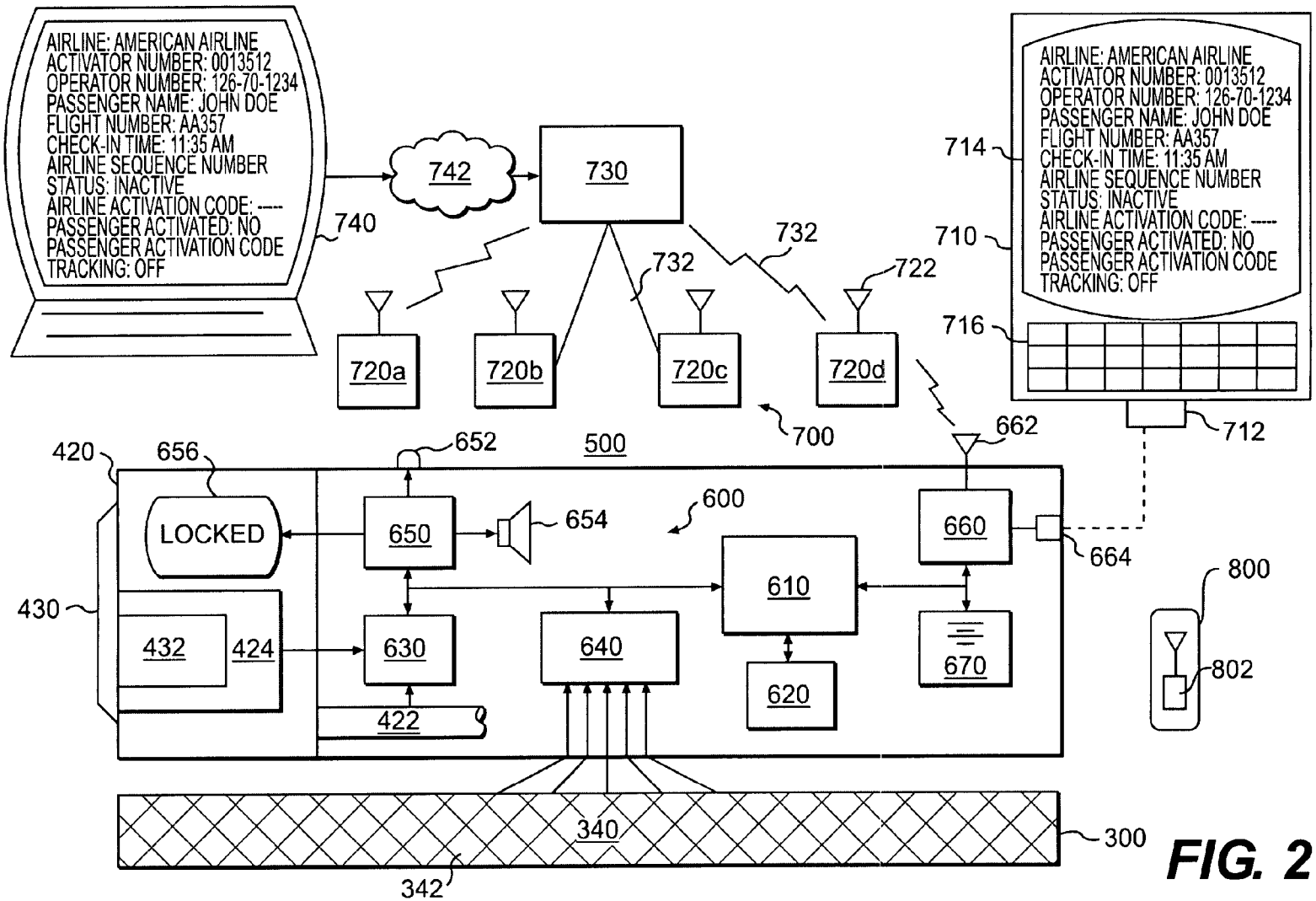
FIG. 2 illustrates an exemplary security system, consistent with the present invention.

In addition to the physical barrier presented by case 300 and closure 400, systems consistent with the present invention may also include electronic security measures. FIG. 2 illustrates an exemplary security system 500 consistent with the present invention. As shown in FIG. 2, security system 500 may include an integrity module 600 and a monitoring network 700.

Integrity module 600 may include a manager 610, a memory 620, a lock sensor (or sensors) 630, a case sensor (or sensors) 640, an indicator (or indicators) 650, a network interface 660, and a power source 670. An embodiment of integrity module 600 may be located on-board each secure container 100 monitored by security system 500. As illustrated in FIG. 2, for instance, integrity module 600 may be located within brace 410. Thus, the structure of brace 410 may deter and prevent unauthorized access to integrity module 600. However, integrity module 600, or one or more of components 610–660, may be located elsewhere on secure container 100, consistent with the present invention.

Manager 610 may manage the operation of sensors 630 and 640, indicator 650 and network interface 660. Manager 610 may be implemented using, e.g., a general purpose computer having a processor that may be selectively activated or configured by a computer program to perform one or more methods consistent with the present invention. Alternatively, manager 610 may be implemented using specially constructed computer or other electronic circuit.

Memory 620 may store computer programs and/or data used by manager 610. Memory 620 may also store identifying information for secure container 100. For example, memory 620 may store a serial number or other identifier for secure container 100. Memory 620 may also store a manifest identifying, for example, the owner or user of secure container 100 (e.g., by name, address, telephone number, ticket number, etc.), shipping information (e.g., container number, origin, intermediate destination, destination, shipper, flight numbers, declared contents, etc.) or security information (e.g., a record of an inspection of secure container 100). The information may be transferred to memory 620 through network interface 660. Memory 620 may be implemented using, e.g., RAM and/or ROM memory.

Manager 610 may be adapted to detect a breach of integrity of secure container 100 via sensors 630 and 640. Manager 610 may also be adapted to indicate a breach of integrity of secure container 100 via indicator 650. Manager 610 may further be adapted to communicate with monitoring network 700 network interface 660.

Lock sensor (or sensors) 630 may be provided to detect a breach of integrity of locking mechanism 420. Lock sensor 630 may be configured to detect if locking mechanism 420 has been forced into an unlocked position. For example, lock sensor 630 may be configured to detect when locking mechanism 420 is in an unlocked state and to determine whether the unlocked state has been authorized.

As illustrated in FIG. 2, for example, lock sensor 630 may be adapted to sense whether lock bar 422 is in a locked position or an unlocked position, e.g., using a detent or other position sensor (not shown). Further as shown in FIG. 2, lock sensor 630 may receive an indication of the authorized state of locking mechanism 420, i.e., locked or unlocked, from lock controller 424. For example, if lock bar 422 is in an unlocked position that has not been authorized by lock controller 424 (e.g., if locking mechanism 420 has been forced open), then lock sensor 520 may indicate a breach of integrity of locking mechanism 420 to manager 610. Manager 610 may then indicate the breach of integrity via indicator 650. Manager 610 may also report the breach to monitoring network 700. For example, manager 610 may transmit a breach signal to monitoring network 700 via network interface 660. The breach signal may identify the particular secure container 100 (e.g., by the identifier contained in memory 620) and indicate that the integrity of the secure container has been breached.

Case sensor (or sensors) 640 may be provided to detect a breach of integrity of case 300. As shown in FIG. 2, for example, case sensor 640 may be operatively linked to an integrity matrix 340 provide on case 300. Matrix 340 may be formed by a mesh of conductive lines 342. Alternatively, matrix 340 may be formed by a single conductive line 342 crossed back across itself.

Matrix 340 may extend across any portion of case 300 that is considered vulnerable to breach. For example, matrix 340 may be coextensive with casing 310. Alternatively, matrix 340 may be provided only in discrete portions of case 300, e.g., in those sections of casing 640 that are considered to be more vulnerable to breach, e.g., due to their construction, materials, or exposed position.

Matrix 340 may be located on an inner or outer surface of casing 310. For example, matrix 340 may be affixed on an inner or outer surface of casing 310, e.g., by gluing, welding, fastening, etc. Alternatively, matrix 340 may be embedded within casing 310. For instance, where casing 310 comprises, e.g., paper, cardboard, or plastic material, or a layered material, etc., matrix 340 may be embedded within the material of casing 310, e.g., during the manufacturing of the material. As illustrated in FIG. 1A, for instance, conductive lines 342 may be embedded within mesh 312 so that a conductive line 342 must necessarily be severed in order to cut through any strand of mesh 312. Where casing 310 comprises a woven material, matrix 340 may be woven within the material of casing 310.

As shown in FIG. 2, case sensor 640 may be located within brace 410 and matrix 340 may be located on case 300. Case sensor 640 may interface with matrix 340 in a variety of ways. For example, the ends of each line 342 of matrix 340 may be placed within knobs 324 of case 300. Case sensor 640 may be placed to operatively engage knobs 324, and thus the ends of line 342, when brace 410 is placed in the locked position. For instance, one end of each line 342 may be placed within a first one of knobs 324 on first cross-piece 322*a*, and an opposite end of each line 342 may be placed in a corresponding one of knobs 324 on second cross-piece 322*b*.

Case sensor 640 may be configured to detect a cut or break in a conductive line 342 of matrix 340. For example, case sensor may be configured to detect a lack of continuity between the ends of line 342. If case sensor 640 detects a cut or break in a conductive line 342 of matrix 340, then case sensor 640 may indicate a breach of integrity of case 300 to manager 610. Manager 610 may then indicate the breach of integrity using indicator 650 and/or report the breach to monitoring network 700 via network interface 660.

In one embodiment consistent with the present invention, line 342 may comprise a light conducting fiber, e.g., a fiber optic line. Case sensor 640 may then be configured to, e.g., input light at one end of line 342 and detect a break or cut in line 342 by sensing that the light is not received at the other end of line 342, or that the light is reflected back to the one end of line 342.

In another embodiment consistent with the present invention, line 342 may comprise an electrically conducting wire or wires. Case sensor 640 may then be configured to detect a break or cut in line 342 by sensing an open circuit between the ends of line 342. For instance, case sensor 640 may be configured to place a small voltage across each line 342 and to detect on open circuit by sensing, e.g., high impedance between the ends of line 342. However, light conducting fibers may be preferred, e.g., where secure container 100 may be subject to x-ray screening, since such fibers may be transparent to x-rays.

Indicator (or indicators) 650 may be provided to indicate a breach of integrity of secure container. Indicator 650 may include audio and/or visual indicators. As illustrated in FIG. 1B, for example, the indicator may include one or more indicator lights 652. As illustrated in FIG. 2, indicator 650 may also include an audio output indicator (such as a speaker) 654 and/or a display 656 (e.g., a liquid crystal display). If sensors 630 or 640 report a breach of integrity of secure container 100, manager 610 may control indicator 650 to provide an indication of the breach. For example, manager may control speaker 654 to sound an alarm if a breach of integrity has been indicated by sensors 630 or 640. As another example, manager 610 may control indicator lights 652 and/or display 656 to display one color (e.g., red) and/or blink if a breach of integrity has been indicated and display another color (e.g., green) in the absence of a breach.

Network interface 660 may be provided to allow communication between integrity module 600 and monitoring network 700. Network interface 660 may comprise a wireless interface, e.g., an RF interface 662, and/or a wired interface 664. Network interface 660 may also be used to indicate a breach of integrity of secure container 100. For example, manager 610 may use interface 660 to report a breach of integrity of secure container 100 to monitoring network 700.

Interface 660 may also be used to access memory 620. For example, a manufacturer or service technician may use interface 660 to upload a new program for manager 610 into memory 620. Also, the owner of secure container 100 may use interface 660 to upload manifest information into memory 620. As another example, the shipper of secure container 100 may use interface 660 to enter shipping information into memory 620. Further, interface 660 may be used by government authorities, such as the Transportation Security Administration or the Customs service, to enter or download security information, e.g., in order to record that the secure container 100 has been inspected.

Communications with network interface 660 may be password protected and/or encrypted to prevent unauthorized persons from gaining control of manager 610 or accessing information in memory 620. Further, different entities may be given different passwords that allow different levels of access to manager 610 and/or memory 620. For example, shippers may be given a password that allows them to change shipping information in memory 620, but not to reprogram manager 610 or to change information identifying the owner of secure container 100.

Power source 670 may be provided to supply electrical power to components 610–660. Power source 670 may comprise, e.g., a battery, such as a rechargeable lithium or NiCad battery.

Monitoring network 700 may be configured to monitor secure containers 100 under the control of a shipper or group of shippers. Monitoring network may be adapted to monitor the integrity of secure containers 100. Monitoring network 700 may also be adapted to locate and/or track the location of secure containers 100 during shipment. Monitoring network 700 may also be adapted to prevent misrouting of secure containers 100. Monitoring network 700 may further be adapted to detect the theft of secure containers 100. As shown in FIG. 2, monitoring network 700 may include one or more authenticators 710, a plurality of monitors 720, a network hub 730, and one or more access terminals 740.

Authenticator 710 may be provided to communicate with integrity modules 600 of secure containers 100 monitored by security system 500. Authenticator 710 may be implemented using any appropriate general purpose or specially constructed computer that may be programmable to carry out methods consistent with the present invention. For example, authenticator 710 may be implemented using a personal computer, network computer, etc. In one embodiment, authenticator 710 may be implemented using a handheld personal digital assistant (PDA). As shown in FIG. 2, authenticator 710 may include a container interface 712 that is compatible with network interface 660 of secured container 100, a display 714, and a data entry device (e.g., a keyboard or keypad) 716.

Authenticator 710 may be used to access memory 620 of secured container 100 via container interface 712. For example, authenticator 710 may be used by owners, shippers or government authorities to access manifest information in memory 620. For instance, a government inspector may use authenticator 710 to determine whether secure container 100 has been inspected, or to determine the owner of secure container 100. Once accessed using the proper password and/or decryption, the manifest information may be displayed on display 714 and/or changed using data entry device 716.

Monitors 720 may be provided to monitor the integrity of secure containers 100 by communicating with secure containers 100. Monitors 720 may include a wireless interface 722 compatible with network interface 660 of secure containers 100. Monitors 720 may send signals to and receive signals from secure containers 100 via wireless interface 722 (as described below).

Monitors 720 may be placed so as to provide continuous monitoring of secure containers 100 throughout shipping. For example, monitors 720 may be placed in areas that secure container 100 may traverse during the normal course of shipment from its origin to its destination under the control of the shipper. In an airline, for instance, monitors 720 may be placed to cover the areas where checked baggage may be located. For example, monitors 720 may be placed to cover checked baggage processing areas, baggage trucks, baggage holds, baggage claim areas, etc.

A network hub 730 may be provided to control monitors 720. Hub 730 may comprise a general purpose computer (e.g., a personal computer, network computer, server, etc.) having a processor that may be selectively activated or configured by a computer program to perform one or more methods consistent with the present invention. Hub 730 may be implemented on a single platform, such as a stand-alone computer. Alternatively, hub 730 be implemented on a distributed network, such as a network of computers connected, e.g., by a LAN, WAN, etc. As shown in FIG. 2, hub 730 may be linked to monitors 720 via wired or wireless interfaces 732. Communications between hub 730 and monitors 720 may be encrypted to prevent unauthorized persons from gaining control of monitors 720.

Monitoring network 700 may be used to monitor the integrity of secure containers 100. As set forth above, if sensors 630 or 640 sense a breach of integrity of secure container 100, manager 610 may report the breach to monitoring network 700 by transmitting a breach signal identifying the particular secure container 100 and indicating that the integrity of the secure container 100 has been breached.

When a particular monitor 720*a* receives a breach signal from a particular secure container 100, monitor 720*a* may then notify hub 730 that the integrity of the particular secure container 100 has been breached. Hub 730 may then report that secure container 100 has been breached in the area covered by monitor 720*a* and request that the breach be investigated. For example, hub 730 may send an automated electronic message to a responsible employee of shipper requesting an investigation.

Monitoring network 700 may also be used to locate and/or track the location of secure containers 100 monitored by security system 500. For example, access terminal 740 may be provided to facilitate requests for the location and/or tracking of secure containers 100 monitored by security system 500. Access terminal 740 may be linked to hub 730 through a network 742, e.g., an intranet or the Internet. Access terminal 740 may be given access to hub through an appropriate middleware program residing on hub 730 or network 742. Access to hub 730 from access terminals 740 may be password protected and/or encrypted to prevent unauthorized use of monitoring network 700. Further, different entities may be given different passwords that allow different levels of access to network 700. For example, the owner of a secure container 100 may be allowed to access location or tracking information for that particular container 100 and no other. By contrast, government authorities may be allowed to request location or tracking of any container 100 monitored by security system 500.

When hub 730 receives an authorized request for the location or tracking of a particular secure container 100, hub 730 may control monitors 720 to locate or track the particular container 100. For example, hub 730 may begin by activating a particular monitor 720 covering the area where the particular secure container 100 is considered most likely to be found, e.g., the area in which the particular secure container 100 is expected to be at that time. For instance, hub 730 may activate monitor 720*b* located in the baggage hold of an flight that the particular secure container 100 is scheduled to be on.

When activated, monitor 720*b* may transmit an locator signal via wireless interface 722. The locator signal may contain the identifier which specifies the particular secure container 100 to be located. The locator signal may then be received by the network interface 660 of each secure container 100 in the broadcast area of monitor 720*b*.

The manager 610 of each secure container 100 that receives the locator signal may then determine if the identifier included in the locator signal matches the identifier in memory 620. If the two identifiers do not match, then manager 610 may ignore the locator signal. However, if the two identifiers do match, then manager 610 may transmit a corresponding response signal identifying secure container 100 to monitor 720*b*.

When monitor 720*b* receives the response signal, monitor 720*b* may notify hub 730 that the particular secure container 100 has been found in the broadcast area of monitor 720*b*. Hub 730 may then report the location of the particular secure container 100 to the access terminal 740 that requested the information. If tracking of the secure container was requested, then hub 730 may periodically reinitiate the location process and provide updated location information to the requesting access terminal 740.

If the particular secure container 100 is not found in the first area searched, hub 730 may proceed by activating the monitor 720*c* covering the area where the particular secure container 100 is considered next most likely to be found, and so on, until the particular secure container 100 is found or all of the monitors 720 in monitoring system 700 have been activated without locating the particular secure container 100. In the latter case, hub 730 may report to the requesting access terminal 740 that the particular secure container 100 has not been found within the area covered by monitoring system 700. Hub 730 may then either initiate another round of locator signals or request a physical search for the particular container 100. For example, hub 730 may send an automated electronic message to a responsible employee of shipper indicating the need for a search.

Monitoring network 700 may also be used to prevent secure containers 100 from being misdirected en route. For example, when a shipper is prepared to ship a plurality of secure containers 100 (e.g., in the cargo hold of a plane, train or truck), hub 730 may activate the particular monitor 720*b* covering the cargo hold. When activated, monitor 720*b* may transmit a check signal via wireless interface 722. The check signal may contain shipping information for the particular shipment, e.g., a flight number. The check signal may then be received by each secure container 100 in the cargo hold.

The manager 610 of each secure container 100 that receives the check signal may then determine if the shipping information included in the check signal matches the shipping information in memory 620. If the information matches, then manager 610 may ignore the check signal. However, if information does not match, then manager 610 may transmit a corresponding error signal to monitor 720*b* indicating that the particular secure container 100 is not scheduled to be in the shipment identified in the check signal.

When monitor 720*b* receives the error signal, monitor 720*b* may notify hub 730 that the particular secure container 100 is on the wrong shipment. Hub 730 may then request that the shipment be held so that the particular secure container may be taken off and correctly routed. For example, hub 730 may send an automated electronic message to a responsible employee of the shipper.

Monitoring network 700 may further be adapted to detect the theft of secure containers 100, e.g., from a baggage claim area. For example, the owner of secure container 100 may be provided with a proximity key 800. Proximity key 800 may include a wireless beacon 802 compatible with network interface 660 of secure container 100. The owner may place proximity key 800 on their person or in their vehicle. The owner may activate proximity key when retrieving secure container from the baggage claim area. When activated, wireless beacon 802 may periodically transmit a low power beacon signal including the identifier for the corresponding secure container 100. For example, the power of the beacon signal may be chosen to be low enough so that the beacon signal will not be detectable by network interface 660 from more than a few yards away. The beacon signal may then be received by each secure container 100 in the broadcast area of wireless beacon 800.

The manager 610 of each secure container 100 that receives the beacon signal may then determine if the identifier included in the beacon signal matches the identifier in memory 620. If the two identifiers do not match, then manager 610 may ignore the beacon signal. However, if the two identifiers do match, then manager 610 may control indicator 650 to alert the owner to the location of secure container 100, e.g., by causing indicator lights 652 to blink or by causing speaker 654 to emit a distinctive sound. Manager 610 may also send a retrieval signal to monitoring network 700 via network interface 660. The retrieval signal may identify the particular secure container 100 and indicate that the owner of the particular secure container 100 has arrived in the baggage claim area.

When the particular monitor 720*d* covering the baggage claim area receives the signal, monitor 720*d* may notify hub 730 that the owner of the particular secure container 100 has arrived in the baggage claim area. Hub 730 may then record that secure container 100 has been retrieved by its owner.

If a secure container 100 is removed from the baggage claim area without first reporting that its owner has arrived (e.g., if secure container 100 fails to respond to an locator signal inside the baggage claim area, or responds to a check signal outside the baggage claim area), then hub 740 may alert authorities near the baggage claim area that a secure container 100 has been removed without authorization. Further, hub 730 may also activate a monitor 720*c* covering an area just beyond the baggage claim area. When activated, monitor 720*c* may transmit an alarm signal via wireless interface 722. The alarm signal may contain an identifier for the particular secure container 100 and an indication that the particular secure container 100 has been removed from the baggage claim area without authorization.

The manager 610 of each secure container 100 that receives the alarm signal may then determine if the identifier included in the locator signal matches the identifier in memory 620. If the identifiers do not match, then manager 610 may ignore the check signal. However, if the two identifiers do match, then manager 610 may control speaker 654 to sound an alarm.

In some embodiments, proximity key 800 may also be configured to respond to locator signals from monitors 720 in the same manner as integrity module 600. Monitoring network 700 may then be used to track people and/or vehicles, etc., in the same manner as secure containers 100.

As set forth above, systems and apparatus consistent with the present invention deter and prevent tampering with shipped containers. Systems and apparatus consistent with the present invention also prevent the misrouting, loss, or theft of shipped containers. By preventing and deterring the removal of items from shipped containers, systems and apparatus consistent with the present invention may prevent and deter theft, e.g., from checked baggage. By preventing and deterring the addition of items such as bombs and contraband to shipped containers, systems and apparatus consistent with the present invention may prevent and deter illegal activities, such as shipment of illegal drugs, or a terrorist attack. Accordingly, systems and apparatus consistent with the present invention may increase security in shipping, thereby lowering the cost of shipping and preventing delays in shipment.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A container comprising:

a casing, the casing having an opening for admitting contents into the container;

a matrix of conductive lines extending across at least a portion of the casing;

a brace, the brace including:

a sensor for sensing a breach of integrity of the matrix;

an indicator operable to indicate a breach of integrity of the container when the sensor senses a breach of integrity of the matrix; and a lock for locking the opening in a closed position, the lock comprising a plurality of tracks for engaging corresponding knobs located on the casing.

2. The container of claim 1, wherein the casing consists essentially of a mesh.

3. The container of claim 1, wherein the matrix comprises conductive lines contained within a mesh.

4. The container of claim 1, wherein the matrix comprises conductive lines.

5. The container of claim 4, wherein the conductive lines comprise at least one of (a) electrically conductive lines and (b) light conductive lines.

6. The container of claim 4, wherein the sensor senses a breach of integrity of the matrix by sensing an open circuit between the ends of one of the conductive lines.

7. The container of claim 1, wherein the indicator comprises at least one of a visual indicator or an audio indicator.

8. The container of claim 1, wherein the indicator comprises a signal transmitted to an electronic monitoring network.

9. The container of claim 1, wherein the lock comprises a biometric scanner for unlocking the lock.

10. The container of claim 1, further comprising:

a sensor for sensing a breach of integrity of the lock; and the indicator being operable to indicate a breach of integrity of the container when the sensor senses a breach of integrity of the lock.

11. A system comprising:

an electronic monitoring network; and a container, the container comprising:

a casing, the casing having an opening for admitting contents into the container;

a matrix of conductive lines extending across at least a portion of the casing;

a sensor for sensing a breach of integrity of the matrix; and an interface operable to:

transmit a breach signal to the monitoring network when the sensor senses a breach of integrity of the matrix, the signal indicating a breach of integrity of the container; and recieve a check signal from the monitoring network, and transmit an error signal to the monitoring network if the interface determines that shipping information contained in the check signal does not match shipping information contained in a memory.

12. The system of claim 11, wherein the matrix comprises conductive lines.

13. The system of claim 12, wherein the conductive lines comprise at least one of (a) electrically conductive lines and (b) light conductive lines.

14. The system of claim 12, wherein the sensor senses a breach of integrity of the matrix by sensing an open circuit between the ends of one of the conductive lines.

15. The system of claim 11, further comprising a lock for locking the opening in a closed position.

16. The system of claim 15, wherein the lock comprises a biometric scanner for unlocking the lock.

17. The system of claim 15, further comprising:

a sensor for sensing a breach of integrity of the lock; and the interface being operable to transmit a signal to the monitoring network when the sensor senses a breach of integrity of the lock, the signal indicating a breach of integrity of the container.

18. The system of claim 11, wherein the monitoring network comprises a plurality of monitors.

19. The system of claim 18, wherein the monitors each comprise a wireless interface.

20. The container of claim 1, wherein the plurality of tracks include a plurality of parallel tracks.

21. The container of claim 20, wherein the plurality of parallel tracks have an open end for recieving the corresponding knobs and a closed end, the lock operable to lock the knobs at the closed end of the corresponding tracks.

22. The container of claim 21, wherein the plurality of parallel tracks have a bend between the open end and the closed end.

23. The system of claim 11, wherein the shipping information includes information identifying at least one of: (a) a container number, (b) an origin of the container, (c) a destination of the container, (d) a shipper of the container, and (e) a flight number for the container.

24. The system of claim 15, wherein the lock comprises a plurality of parallel tracks for engaging corresponding knobs located on the casing.

25. The system of claim 24, wherein the plurality of parallel tracks have an open end for recieving the corresponding knobs and a closed end, the lock operable to lock the knobs at the closed end of the corresponding tracks.

26. The container of claim 25, wherein the plurality of parallel tracks have a bend between the open end and the closed end.

* * * * *